US008522463B2

(12) United States Patent
Ong et al.

(10) Patent No.: US 8,522,463 B2
(45) Date of Patent: Sep. 3, 2013

(54) IRONING DEVICE

(75) Inventors: Chee Keong Ong, Singapore (SG); Wee Ann Chong, Singapore (SG); Boon Khian Ching, Singapore (SG)

(73) Assignee: Koninklijke Philips N.V., Eindhoven (NL)

( * ) Notice: Subject to any disclaimer, the term of this patent is extended or adjusted under 35 U.S.C. 154(b) by 96 days.

(21) Appl. No.: 13/143,624

(22) PCT Filed: Jan. 8, 2010

(86) PCT No.: PCT/IB2010/050056

§ 371 (c)(1),
(2), (4) Date: Jul. 7, 2011

(87) PCT Pub. No.: WO2010/086755

PCT Pub. Date: Aug. 5, 2010

(65) Prior Publication Data

US 2011/0271566 A1 Nov. 10, 2011

(30) Foreign Application Priority Data

Jan. 28, 2009 (EP) ..... 09151538

(51) Int. Cl.
*D06F 75/20* (2006.01)
*D06F 75/08* (2006.01)

(52) U.S. Cl.
USPC ..... 38/77.9

(58) Field of Classification Search
USPC ..... 38/74–77.83, 90–92; 219/250, 254, 219/256, 257
See application file for complete search history.

(56) References Cited

U.S. PATENT DOCUMENTS

| | | | | |
|---|---|---|---|---|
| 1,365,186 | A * | 1/1921 | Oca Balda | 219/248 |
| 2,418,511 | A | 4/1947 | Hume | |
| 2,427,474 | A | 9/1947 | Purpura | |
| 2,664,653 | A * | 1/1954 | Voskresenski | 38/77.8 |
| 2,674,054 | A * | 4/1954 | Maykemper | 38/77.1 |
| 2,708,801 | A * | 5/1955 | Voskresenski | 38/77.83 |
| 3,224,122 | A * | 12/1965 | Jepson et al. | 38/77.2 |
| 3,986,282 | A * | 10/1976 | Nelson | 38/77.83 |
| 6,249,996 | B1 * | 6/2001 | Dorber et al. | 38/77.5 |

FOREIGN PATENT DOCUMENTS

FR 602293 A 3/1926

* cited by examiner

*Primary Examiner* — Ismael Izaguirre

(57) ABSTRACT

An ironing device includes a base, a handle moveable relative to the base, and a resilient member biasing the handle in an upper position and allowing movement of the handle upon exertion of a force thereon by a user towards a lower position. Further, a steam controller is operatively connected to the handle such that release of steam of the ironing device is intuitively controlled by the force exerted on the handle by the user. A console is connected with the base and is provided with at least one operating button. The handle includes a recess for accommodating the console, where the console and the handle are configured so that an operating button is operable with the same hand that holds the handle.

9 Claims, 5 Drawing Sheets

IRONING DEVICE

FIELD OF THE INVENTION

The invention relates to ironing devices. More particularly the inventions relates to the arrangement and constructive design of a handle of an ironing device.

BACKGROUND OF THE INVENTION

In the art several ironing devices have been proposed. The French Patent FR 602 293 proposes an ironing device with a pivotely connected handle, which, upon the application of an operating force thereon, opens a valve such that steam is being generated. After removal of the operating force, the valve shuts and the generation of steam is stopped.

A drawback of this ironing device is that the pivot of the handle of this device is positioned at the rear end of the handle, thus requiring the user to apply an unpractical, forwardly tilted force to the handle in order to release the steam.

A further drawback is that the ironing device in this document does not allow the control of other functions such as e.g. a spray function, a shot of steam function, dosing and/or metering functions in a practical way.

SUMMARY OF THE INVENTION

The object of the invention is to provide an ironing device that is overcoming or alleviating at least one of the drawbacks of ironing devices of the art while maintaining the advantages thereof. Further objects of the invention may be to improve the comfort of use of ironing devices while maintaining a robust, effective, economical and practical design.

At least one of these and/or other objects are reached by an ironing device comprising: a base; a handle moveable relative to the base; a resilient member biasing the handle in an upper position and allowing movement of the handle upon exertion of a force thereon by a user towards a lower position; a steam controller operatively connected to the handle such that the release of steam of the ironing device at least in part is intuitively controlled by the force exerted on the handle by the user; a console that is connected with the base and that is provided with at least one operating button; and at least one recess in the handle at least partly accommodating the console, the console and the handle being configured so that the at least one operating button is operable with the same hand that holds the handle.

By this arrangement, the user can intuitively control the amount of steam and/or the temperature of the ironing device while simultaneously he/she can control the additional features such as e.g. a steam pulse, a water spray pulse and/or other features.

Due to the recess within the handle, the console is allowed to remain fixed within the pivotable handle. The handle is allowed to move independently from the console, the buttons and/or displays while these remain embedded within the handle. Thus the operation of this ironing device becomes intuitive without losing the operational advantages of the additional buttons, controls and/or displays of the ironing device.

Accordingly, the user can operate the ironing device and control the intuitive emission of steam and the other buttons and controls with one and the same hand. The hand of the user can remain in the same position during the operating of any of the buttons and/or the controls.

Since the console with the buttons and/or controls remains installed on the base, the vulnerable parts can be firmly and simply mounted into the device. Thus a practical and easily operable ironing device is proposed, that remains robust and requires a relatively uncomplicated design and manufacture.

Another advantage is that, by this arrangement, the moving of the handle prevents unintentional interference with any control and/or any button, so that the unintentional pressing of any of these controls and/or buttons is avoided.

A further aspect of the invention is a method of ironing comprising the steps of: providing an ironing device as described above, exerting a force on the handle such that it moves relative to the base and intuitively controlling the amount of steam emitted by the ironing device by exerting more or less force to the handle.

Further embodiments can be found in the dependent claims. These and other aspects of the invention will be apparent from and elucidated with reference to the embodiments described hereinafter.

BRIEF DESCRIPTION OF THE DRAWINGS

For a better understanding, embodiments of the ironing device will be further elucidated by the following Figures, wherein.

In the figures and the description the same or corresponding parts will have identical or similar reference signs. The embodiments shown should not be understood as limiting the invention in any way or form.

DETAILED DESCRIPTION OF THE EMBODIMENTS

Figure 1:
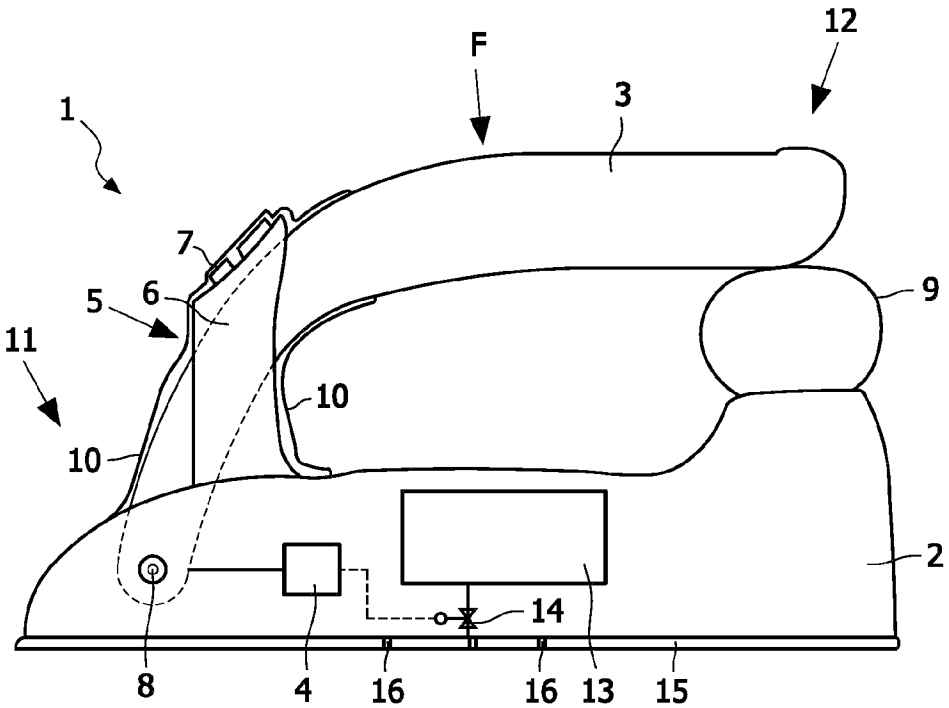
FIG. 1 is a schematic side view of a first embodiment.

FIG. 1 depicts a side view of an ironing device 1. The ironing device 1 comprises a base 2 and a handle 3. Below the base 2, and ironing sole 15 is arranged, which can be provided with steam and/or water holes 16. Inside the base 2 or the handle 3 a reservoir 13 is arranged for water. Although in FIG. 1 the reservoir is arranged within the ironing device, alternatively the reservoir can be a separate or remote reservoir, for instance connected to the ironing device by means of a water or steam transporting line. During the use of the ironing device 1, steam can be generated and released or emitted upon the cloth to be ironed through the holes 16.

In FIG. 1, the handle 3 is pivotely connected to the base 2 by means of a pivot 8. The handle 3 is further provided with a cut out or recess 5 wherein a console 6 is placed. On the console 6, operating buttons, controls 7 and/or displays may be arranged. The lower side the console 6 is mounted on the base 2 of the ironing device 1.

The handle 3 may, for example be at its rear side 12 provided with a resilient element 9. This resilient element 9 can for instance be a rubber bellow, a sleeve with e.g. a spring incorporated therein and/or made of other resilient material.

At the front end side of the handle 2, for protection of the inner parts from water or steam entering, the handle 2 may be provided with a flexible protecting seal 10. This flexible protecting seal 10 may be, for instance, a transparent rubber sleeve, which closes off the pivoting connection between the base 2 and the handle 3, which can further also enclose the console 6 and the buttons and/or the controls 7.

The handle 3 is connected to a controller 4 that can control the amount of steam being emitted. In order to control the amount of steam being emitted, the controller 4 may be connected to a valve 14 which can for instance open a connection between the reservoir 13 and the sole 15. The control 4 may be of an electrical, mechanical and an electromechanical nature. The water can evaporate during its travel through the sole 15 and thus provide additional steam to the cloth to be ironed.

In case the handle 3 is pressed down further, the controller 4 can be adapted to open the valve 14 even more such that more steam is generated and emitted. Thus the user of the ironing device 1 may adjust the amount of steam being emitted and learn to intuitively operate the ironing device 1.

The resilient element 9 can for instance provide an increasing counterforce when the handle 3 is forced down. Thus the relative motion in relation to the force applied to the handle 3 can be set. Also the relative opening of the steam valve 14 can be adapted such that a well designed relation between the force applied on the handle and the amount of steam being emitted can be precisely adjusted.

Examples of graphs representing different relations between the amount of force exerted on the handle 3 and the amount of steam being emitted can de found in FIGS. 5*a-d*, which are described in more detail further below.

Since the flexible protecting seal 10 can be attached to the handle 3 as for instance a tight fitting transparent sleeve, the buttons 7 and/or the controls on the console 6 can be visible and can be operated. During a slight pivoting of the handle 3 relative to the base 2, the flexible protecting seal 10 will flex and allow the handle 3 to be rotated without resistance. Thus the controls and/or the buttons 7 remain operable by the user, even by means of the very same hand the user is using to exert the force upon the handle 3.

Thus an ironing device 1 is obtained that is provided with increased user convenience and a more adaptive steam supply.

Figure 2:
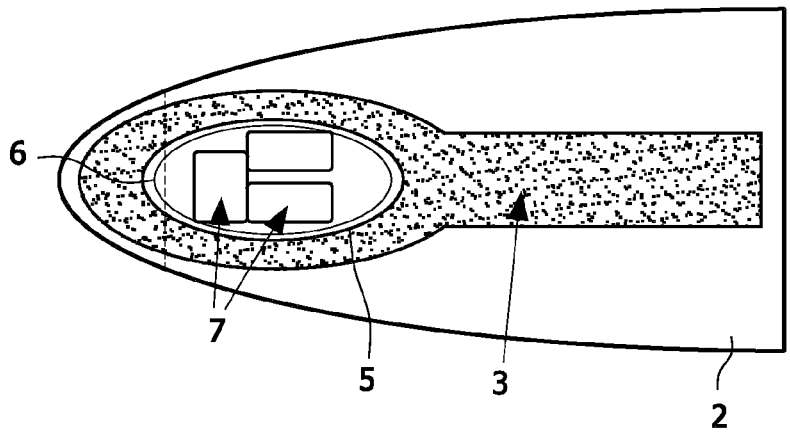
FIG. 2 is a schematic top view of a second embodiment.

In FIG. 2, a top side view of a second embodiment of the invention is presented. In this embodiment the recess or the cut out 5 is provided as a central opening within the handle. The buttons and/or controls 7 are positioned on a console 6 that is—from a top side view—surrounded by the handle 3. In this embodiment, the buttons, controls 7 and/or displays are thus a fixed island within the pivotable handle 3. Other stationary elements within the fixed console 6 can be a water filling hole, a knob, a steam selector slide, a steam and/or water spraying nozzle, a lime build up protector and/or other functional parts of a conventional ironing device.

Figure 3:
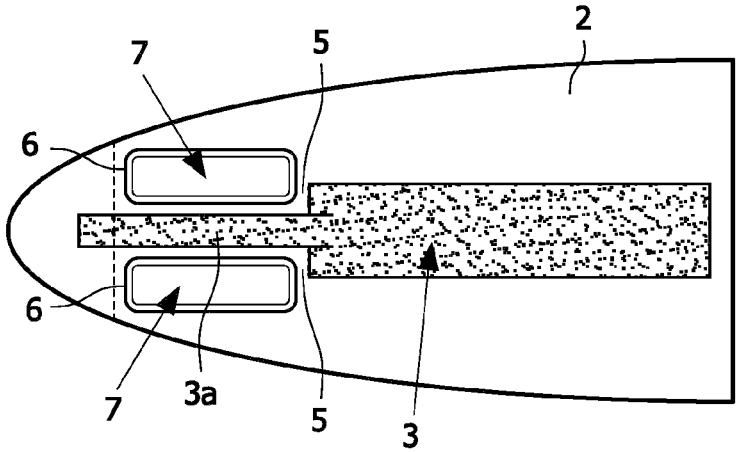
FIG. 3 is a schematic top view of a third embodiment.

In an alternative embodiment as represented by FIG. 3 the buttons and/or controls 7 are distributed around a central part 3*a* of the handle 3, where these buttons and/or controls 7 are positioned upon a divided console 6, which is arranged on each side of the handle 3.

Figure 4A:
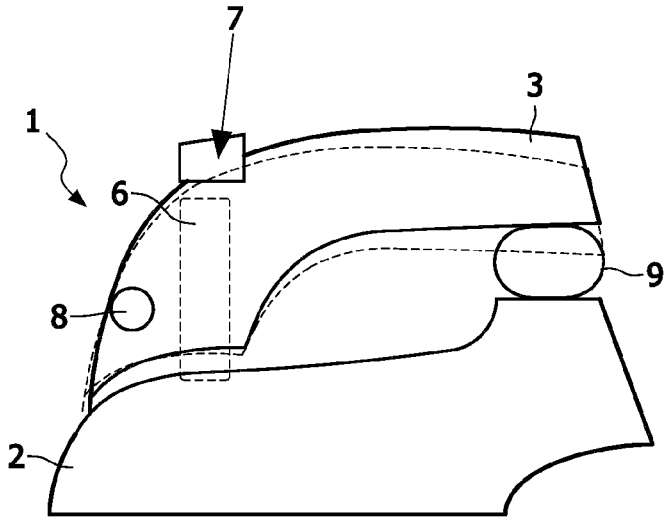
FIG. 4A is a schematic side view of a fourth embodiment in a first position.
Figure 4B:
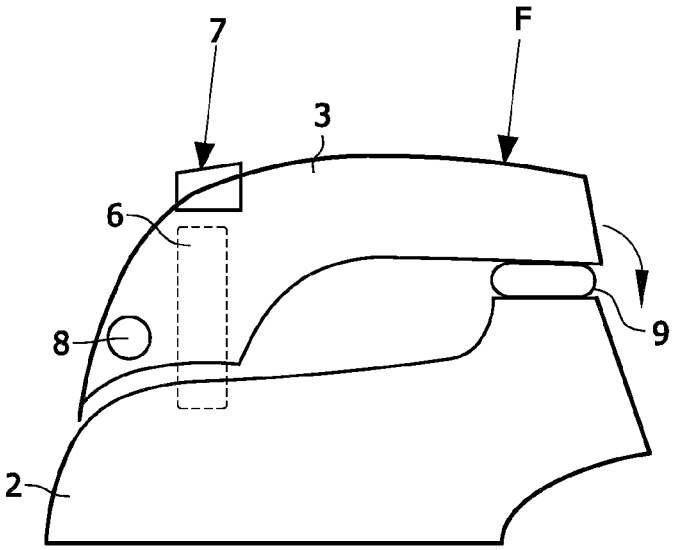
FIG. 4B is a schematic side view of a fourth embodiment in a second position.

In both the embodiments shown in FIGS. 2 and 3 as well the embodiments shown in FIGS. 4A and 4B, the consoles 6 are base 2 mounted, whereas the handle 3 is pivotly connected to the base 2 and rotates relative to the base 2 as well as relative to the consoles 6. In these embodiments the handle 3 can preferably rotate around a pivot that is arranged at the front side end 11 of the handle 3.

The front side portion 11 of the handle 3 may be a separate portion attached to the handle 3 in a robust way. This front end portion 11 may be a flexible sealing member. It can for instance be a continuous structure in order to provide maximum rigidity, although constructions with openings reinforced for rigidity may also be considered. These reinforcements may be in the form of flanges, curved walls, ribs etc. which can be formed together with the front end portion or can alternatively be attached thereto.

In the embodiments shown in FIG. 4A the ironing device 1 is shown in a first position where the handle 3 is in its higher position relative to the base 2. In dashed lines the lower position of the handle 3 is depicted. In FIG. 4B, the lower position of the handle 3 is depicted where the resilient member 9 is compressed. As can be seen in the FIGS. 4A and 4B, the console 6 together with the buttons and/or controls 7 do not move relative to the base 2.

The downward motion of the handle 3 may be restricted or controlled by means of a stopper at the rear end 12 of the handle 3. The rear end 12 could be provided with an effective stopping tolerance tool such as a resilient element 9.

As the activation of the steam emission via the pivoting handle 3 should be intuitive, the movement of the handle 3 can be kept at a minimum such that it allows easy and low effort activation of the steam emission during ironing strokes. The pivoting movement of the handle 3 could therefore be less than 10 degrees or the translational movement of the rear end of the handle could be less than 15 mm.

Since the consoles 6 and the buttons and/or controls 7 are not moving or rotating in relation to the base 2, all the connections and wiring can be fixedly and durably be connected. By the resilient element 9 and/or the flexible protecting seal 10, the inner components can be protected from water and/or dust ingress. The front end 11 of the handle 3, when arranged as a flexible portion could may prevent the material from cracks or fissures due to the hinging effects of the handle 3.

Both the flexible seal 10 and the resilient element 9 provide protection of the internals of the ironing device and may be produced with in-mold techniques or may alternatively be fixed separately to the base 2 and/or the handle 3. The resilient element 9 and the protective seal 10 can further provide additional esthetical functionality to the ironing device 1.

In these embodiments, the intuitive handle can be constructed in such a way as to allow easy activation of the steam emission during ironing strokes. A front end pivoting or hinging handle turns out to be easily able to be activated and thus to emit steam. Because of the arrangement of the pivot at the front end side of the handle, a downward force application during a forward stroke happens naturally as the user pushes the iron forward. In the backward stroke, generally the user tends to iron over the same area as in the forward stroke, during which the user tends to apply less downward force. Due to the resilient nature of the resilient element, the handle is moved upwards, thus decreasing the amount of steam being emitted during the backward stroke. In this way with the ironing device according to these embodiments, during an ironing exercise less energy could be needed. Thus the operating costs may be reduced in a beneficial way.

Figure 5A:
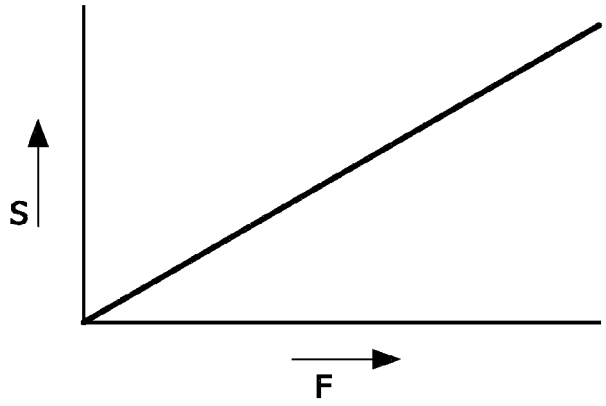
FIG. 5A-D is a set of graphs representing schematically several embodiments of a relation between the force exerted onto the handle and the amount of steam being emitted.

In FIG. 5A-D schematic relations between the exerted force F and the amount of steam S are depicted. In these diagrams the abscissa represents the amount of force F that is exerted on the handle 3 and the ordinate represents amount of steam S being emitted. In FIG. 5A a linear relation between the amount of force and the amount of steam being emitted is given. For a user this means that twice as forceful using the ironing device means twice as much steam.

Figure 5B:
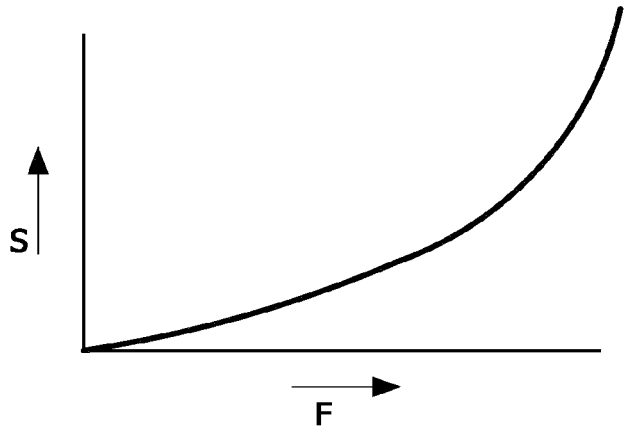

In FIG. 5B the amount of steam being emitted exponentially increases with the amount of force being applied. This means that a user has to apply a lot of force to obtain some steam whereas an additional amount of force will further extra proportionally increase the amount of steam being emitted.

Figure 5C:
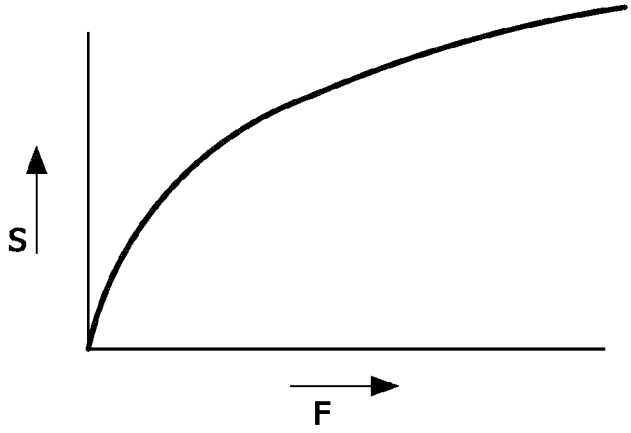

In FIG. 5C the amount of steam being emitted when only a minor force is applied will be relatively high, whereas the incremental steam production will with considerable additional force only be limited.

Figure 5D:
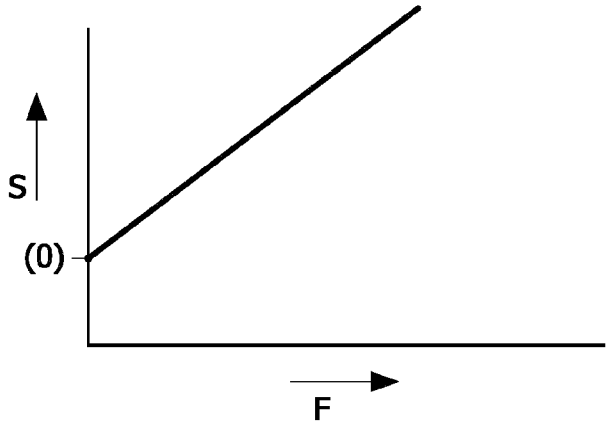

In FIG. 5D even when no force is applied, some offset steam is emitted anyhow. In the FIGS. 5A to 5C only steam is emitted when at least some force is exerted upon the handle whereas in the embodiment of FIG. 5D a basic steam production is provided irrespective of the force being exerted.

While the invention has been illustrated and described in detail in the drawings and the foregoing description, such illustration and description are to be considered illustrative or exemplary and not restrictive; the invention is not limited in any way or form to the disclosed embodiments. In any embodiment of the invention as described before numerous adaptations and modifications are possible. For instance the reservoir 13 is described to contain water. Other fluids or mixtures thereof can similarly be applied. Examples thereof might be starch or alcohol containing fluids and/or softeners containing fluids. The handle 3 is depicted to rotate from a pivot 8 arranged at the front side 11 of the handle. The pivot can also be a resilient element that flexes and thus allows a rotating motion of the handle. Alternatively the handle 3 may be shifted downwards a little by the first and second resilient element. In this alternative the handle can be pushed down in order to obtain the emission of steam.

In the description the console is described to comprise buttons, controls, displays, water filling holes, steam and/or water spraying nozzles, knobs, dials and other functions. The amount of functions is not limited to these described elements, other functions and elements can be incorporated within the console 6 as well. For example special component dosing such as softener components, stiffening components and/or other functionalities may similarly be integrated within the console.

Throughout this text and the claims, the term resilient, flexible and/or flexible material(s) is to be understood but not limited to special materials that are resilient in that they regain their original shape after deformation. Examples of flexible materials are rubber, like silicon rubber, natural rubber, butadiene rubber, different elastoplastic materials and the like. Also other synthetic or natural resilient materials can be used.

Other materials can have a similarly high elastic limit due to their specific shape. Springs of any kind and of any material can hold these very same resilient properties.

Throughout this text the wording front end or front end portion refers to the front end of the ironing device or the front end of the handle, being typically that end that is pointing in the same direction as the tip of the elongated triangular arrowhead shape of the sole 15 of the ironing device 1. Typically, users grab the ironing device automatically such that the thumb of the user is positioned directing towards the front end side of the handle and the ironing device.

Throughout the text the term intuitive and or intuitively refers to a skill of a user that he or she automatically develops during the use of the device. The relation between the amount of steam being emitted or released and the amount of force being applied upon the handle during use will automatically be appreciated and understood by the user, and he she will very soon automatically adapt the applied force in order to emit the amount of steam necessary. Thus the user automatically develops a skill for the application of the correct amount of force that is based solely upon experience, practise and the development of a feeling thereto.

The invention claimed is:

1. An ironing device comprising:

a base;

handle moveable relative to the base;

a resilient member biasing the handle in an upper position and allowing movement of the handle upon exertion of a force thereon by a user towards a lower position;

a steam controller operatively connected to the handle such that emission of steam from the ironing device is controlled by the force exerted on the handle by the user; and a console that is connected with the base and that is provided with at least one operating button; and wherein the handle includes at least one recess for at least partly accommodating the console, the console and the handle being configured so that the at least one operating button is operable with a same hand that holds the handle, wherein the handle is provided with a resilient portion comprising a bellow made of flexible material.

2. The ironing device according to claim 1, wherein the at least one recess includes a central hole in the handle that is bounded by hole bounding wall parts of the handle, wherein the hole bounding wall parts extend entirely around the console.

3. The ironing device according to claim 1, wherein the at least one recess includes at least one indentation in a lateral side of the handle, the indentation being bounded by indentation bounding wall parts of the handle, wherein the indentation bounding wall parts partly extend around the console.

4. The ironing device according to claim 1, wherein the handle is pivotable around a pivot being arranged at front end side of the handle.

5. An ironing device comprising:

a base;

handle moveable relative to the base;

a resilient member biasing the handle in an upper position and allowing movement of the handle upon exertion of a force thereon by a user towards a lower position;

a steam controller operatively connected to the handle such that emission of steam from the ironing device is controlled by the force exerted on the handle by the user; and a console that is connected with the base and that is provided with at least one operating button; and wherein the handle includes at least one recess for at least partly accommodation the console, the console and the handle being configured so that the at least one operating button is operable with a same hand that holds the handle, and wherein the handle is provided with a flexible protecting seal.

6. The ironing device according to claim 5, wherein the flexible protecting seal is a flexible transparent sleeve, closing the gaps between the pivotal handle and the console or the gaps between the handle and the base.

7. The ironing device according to claim 1, wherein the recess is provided with at least one of a steam dosing control, a temperature control, a water spray control, a steam spray control, displays, indicators, switches, buttons, and a water filling opening.

8. The ironing device according to any preceding claims, wherein the handle is able to rotate relative to the base within an angle of 10 degrees and/or at a distance of about 15 mm measured at the rearward end of the handle.

9. A method of ironing comprising the acts of:

providing an ironing device having a handle moveable relative to the base;

exerting a force on the handle such that the handle moves relative to the base; and controlling amount of steam emitted by the ironing device varying an amount of the force to the handle, wherein the handle is provided with a resilient portion comprising a bellow made of flexible material.

* * * * *